US008449365B2

(12) United States Patent
Nardizzi et al.

(10) Patent No.: US 8,449,365 B2
(45) Date of Patent: May 28, 2013

(54) SYSTEM AND METHOD OF INCREASING POKER TOURNAMENT POOLS AND NUMBER OF PAYOUT POSITIONS

(75) Inventors: Robert V. Nardizzi, Las Vegas, NV (US); Robert J. Miller, Las Vegas, NV (US)

(73) Assignee: Bubbleproof Me, LLC, Las Vegas, NV (US)

( * ) Notice: Subject to any disclaimer, the term of this patent is extended or adjusted under 35 U.S.C. 154(b) by 0 days.

(21) Appl. No.: 13/532,428

(22) Filed: Jun. 25, 2012

(65) Prior Publication Data

US 2012/0264498 A1 Oct. 18, 2012

Related U.S. Application Data

(63) Continuation of application No. 12/410,690, filed on Mar. 25, 2009, now Pat. No. 8,272,933.

(60) Provisional application No. 61/113,215, filed on Nov. 10, 2008.

(51) Int. Cl.
*A63F 9/24* (2006.01)

(52) U.S. Cl.
USPC ..... 463/13

(58) Field of Classification Search
USPC ..... 463/13, 25
See application file for complete search history.

(56) References Cited

U.S. PATENT DOCUMENTS

| | | | | |
|---|---|---|---|---|
| 6,334,614 | B1 | 1/2002 | Breeding | |
| 6,789,801 | B2 * | 9/2004 | Snow | 273/292 |
| 2006/0073882 | A1 * | 4/2006 | Rozkin et al. | 463/25 |
| 2006/0211473 | A1 | 9/2006 | Walker et al. | |

OTHER PUBLICATIONS

Rosales, Rebecca, "Hollywood Poker Offering Bubble Insurance", www.internetpoker.com/Poker-News/Poker-Sites/Hollywood-Poker, Jul. 15, 2008, 1 page.

* cited by examiner

*Primary Examiner* — Brook Kebede
(74) *Attorney, Agent, or Firm* — Greenberg Traurig

(57) ABSTRACT

A second optional poker tournament fee allows participating players a chance to receive a payout when finishing the poker tournament in one of one or more extra bubble spots. So, if the player finishes close to the conventional bubble position the player may receive a payout if he or she paid the second optional fee. The number of extra spots is based on the number of second optional fees paid. In one version, if no players finish in the extra bubble spots the house collects the second optional fees as profits. In another version, the second optional fees, or a portion thereof, are used to increase the payouts associated with the conventional payout scheme independent of the second optional fees.

15 Claims, 6 Drawing Sheets

101

| 135 | 140 | 145 | 150 | 155 | 160 |
|---|---|---|---|---|---|
| Extra Fee | Extra Tournament Fee | Bubble Funds | Extra House Revenue | Bubble Spot Payouts | Extra/Total Places Paid |
| $50 | $58,500 | $40,950 | $17,550 | $1,000 | 40/157 |

Fig. 2a

102

| 136 | 141 | 146 | 151 | 156 | 161 |
|---|---|---|---|---|---|
| Extra Fee | Extra Tournament Fee | Bubble Funds | Extra House Revenue | Bubble Spot Payouts | Extra/Total Places Paid |
| $30 | $35,100 | $24,570 | $10,530 | $1,000 | 10/127 |

Fig. 2b

SYSTEM AND METHOD OF INCREASING POKER TOURNAMENT POOLS AND NUMBER OF PAYOUT POSITIONS

CROSS REFERENCE TO RELATED APPLICATIONS

This application is a continuation of U.S. patent application Ser. No. 12/410,690 filed Mar. 25, 2009 now U.S. Pat. No. 8,272,933 which claims the benefit of U.S. Provisional Application No. 61/113,215 filed Nov. 10, 2008.

FIELD OF THE INVENTION

The embodiments of the present invention relate to a system and method of increasing poker tournament pools and a number of payouts with a focus on providing a larger number of bubble payouts.

BACKGROUND

With television coverage, poker has become extremely popular. Accordingly, poker games attract larger player pools and prize monies. Poker tournaments have seen dramatic increases in the number of entrants and prize pools. In a typical poker tournament the top 10% of the entrants receive a payout. For example, if 100 players enter a poker tournament, the final 10 players will receive a payout. Using the same example, the players that finish in $11^{th}$ to $15^{th}$ are said to be on the bubble (i.e., close to the money but not quite). In many circumstances, especially with large fields and long tournaments, players prefer to be knocked out early rather than finish in a bubble position.

Thus, it would be advantageous to provide players with an opportunity to receive a payout when finishing near a bubble position but in a position not normally paid.

SUMMARY

Accordingly, a first embodiment of the present invention is a method of conducting a poker tournament comprising: accepting a poker tournament entry fee; determining a payout scheme based on a number of poker tournament entry fees accepted, said payout scheme including a first number of finishing spots to be paid; accepting second optional fees from players; tracking each player placing the second optional fee; adding one or more extra finishing spots to the first number of finishing spots to be paid based on a number of second optional fees accepted; and limiting extra finishing spot payouts to players paying said second optional fee.

Another embodiment of the present invention is a method of conducting a poker game comprising: accepting a poker tournament entry fee; determining a payout scheme based on a number of poker tournament entry fees accepted, said payout scheme including a first number of finishing spots to be paid; accepting second optional fees from players; providing players paying said second optional fees with proof of payment; adding one or more extra finishing spots to the first number of finishing spots to be paid based on a number of second optional fees accepted; displaying said first number of finishing spots, extra finishing spots and corresponding payouts whereby extra finishing spot payouts are limited to players paying said second optional fee.

Another embodiment of the present invention is an electronic poker system configured for play over a computer network accessible by player terminals, said terminals including at least a display and user interface, comprising: computer means programmed to: accept poker tournament entry fees; determine a payout scheme based on a number of accepted poker tournament entry fees, said payout scheme including a number of finishing spots to be paid; accept a second optional fee from players; track each player placing the second optional fee; adding one or more extra spots to the number of finishing spots to be paid based on a number of second optional fees accepted; and limit payouts corresponding to said extra spots to players placing said second optional fee.

With the embodiments of the present invention, players may pay an optional fee that provides a payout should the player finish the tournament in one of one or more extra bubble spots added to the number of finishing spots to be paid. So, if the player finishes close to the conventional bubble position the player may receive a payout if he or she paid the second optional fee. The number of extra spots is based on the number of second optional fees paid. In one embodiment, if no players finish in the extra spots the house collects the second optional fees as profits. In another embodiment, the second optional fees, or a portion thereof, are used to increase the payouts associated with the conventional payout scheme independent of the second optional fees.

Other variations, embodiments and features of the present invention will become evident from the following detailed description, drawings and claims.

BRIEF DESCRIPTION OF THE DRAWINGS

FIGS. 2*a*-2*c* illustrate modified payout schemes for the poker tournament of FIG. 1 according to a first embodiment of the present invention.

DETAILED DESCRIPTION

Figure 1:
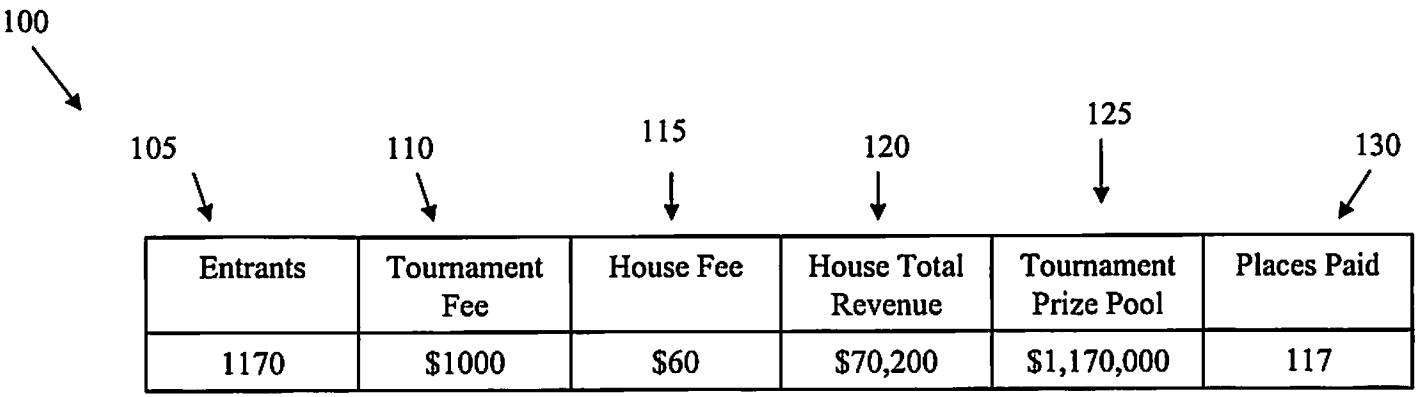
FIG. 1 illustrates a conventional payout scheme for a poker tournament.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

The embodiments of the present invention are ideal for poker tournaments and the disclosure below focuses on poker. However, those skilled in the art will recognize that other tournament games may benefit from the embodiments as well.

FIG. 1 shows a conventional payout scheme 100 for a conventional poker tournament. The payout scheme is based on 1170 entrants 105 each paying $1000 tournament entry fee 110 plus a $60 house fee 115 creating a total prize pool of $1,170,000 (1170×$1000) 120. The house collects $70,200 (1170×$60) as its fee 125. The house may also take a percentage (e.g., 2%-10%) of each entry fee for conducting the poker tournament rather than the additional fee on top of the entry fee. In this example, as shown, the top 117 places 130 are paid. Normally first place is paid 50% of the prize pool while the remaining 116 players share the other 50%. The term "on the bubble" is the final spot immediately preceding the start of payouts. In this example, the player finishing in the 118$^{th}$ spot is said to finish on the bubble. More generally, the term bubble means any spot near the first payout spot. With the top 117 spots being paid, spots 118-125 (or any other suitable range) may be considered bubble spots (i.e., spots close to making the money but receiving nothing).

Figure 2C:
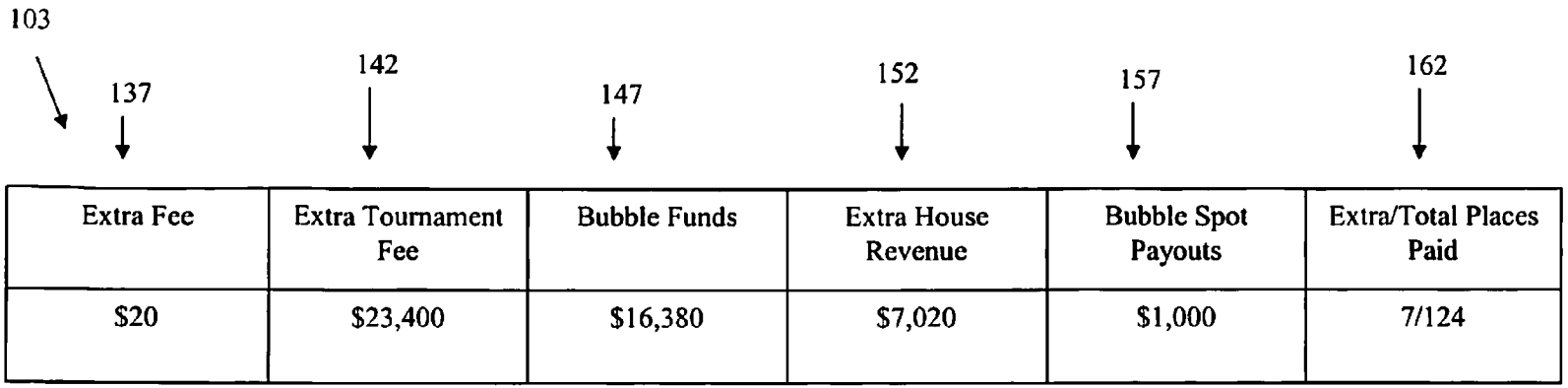

The embodiments of the present invention expand payouts to bubble spots for those entrants paying a second optional or extra fee in addition to the conventional poker tournament entry fee. In one embodiment, the extra fee (aka Hedge Bet) is 5% of the entry fee. Those skilled in the art will recognize that any percentage (1%-20% or more) of the entry fee or fixed fee may be used to establish the extra fee and is within the spirit and scope of the present invention. FIG. 2*a* shows a chart 101 with a 5% second optional or extra fee 135 based on the $1000 entry fee 110. FIG. 2*a* assumes that all entrants elect to pay the second optional fee 135 generating $58,500 (1170×$50) 140. In one embodiment, 70% of the collected second optional fees 135 are used to fund payouts for additional bubble spots. In this instance, a pool of $40,950 (70%×$58,500) 145 is generated and $17,550 (30%×$58,500) 150 is collected by the house. The $40,950 can be used to fund the payouts for the additional bubble spots. In one embodiment, the payouts for the additional bubble spots are each equal to the $1000 entry fee. So, in this instance, the $40,950 allows an additional 40 bubble spots to be paid $1000. Thus, a total of 157 spots (117 conventional+40 additional bubble spots) are paid. The extra $950 may be used to provide another bubble spot payout, may be collected as revenue or used as the operator desires. In other embodiments, the payouts for additional bubble spots may be increased and the number of additional bubble spots may be decreased. For example, in this instance an additional 20 bubble spots may each be paid $2000. Those skilled in the art will recognize that any conceivable manipulation of payouts and additional bubble spots may be utilized according to the embodiments of the present invention. In this example, each player finishing in one of the 40 bubble spots will receive a payout since each entrant paid the second optional fee. Besides providing players with an opportunity to receive a return when finishing in a bubble spot, the second optional fees also provide the house with additional revenue. The $18,500, when added to the $70,200 house hold, is a 26% increase for the house from the identical poker tournament. FIGS. 2*b* and 2*c* show charts 102, 103 listing extra fees of 3% and 2%, respectively, of the poker tournament fees. Charts 102, 103 have the same entry fee of $1000 and the same number of entrants 1170 as set forth in charts 100, 101. As listed in chart 102 of FIG. 2*b*, $30 is the extra fee 136, $35,100 is the extra tournament fee total 141, $24,570 (70%×$35,100) is allocated to bubble funds 146, $10,530 (30%×$35,100) is allocated as house revenue 151, $1000 is used to pay bubble spots 156 and 10 extra bubble payout spots 161 are created. As listed in chart 103 of FIG. 2*c*, $20 is the extra fee 137, $23,400 is the extra tournament fee total 142, $16,380 (70%×$23,400) is allocated to bubble funds 147, $7,020 (30%×$23,400) is allocated as house revenue 152, $1000 is used to pay bubble spots 157 and 7 extra bubble payout spots 162 are created.

It is unlikely that all players entering a tournament will pay the second optional fee. Thus, there will be situations where no player paying the second optional fee will finish in the additional bubble spots. In such instances, the house collects 100% of the second optional fees. That is, the payouts associated with the additional bubble spots can only be won by players paying the second optional fee prior to the tournament starting. Alternatively, the house may elect to hold only a percentage of the second optional fees and enhance the conventional fees using the remaining percentage of the second optional fees.

Figure 3:
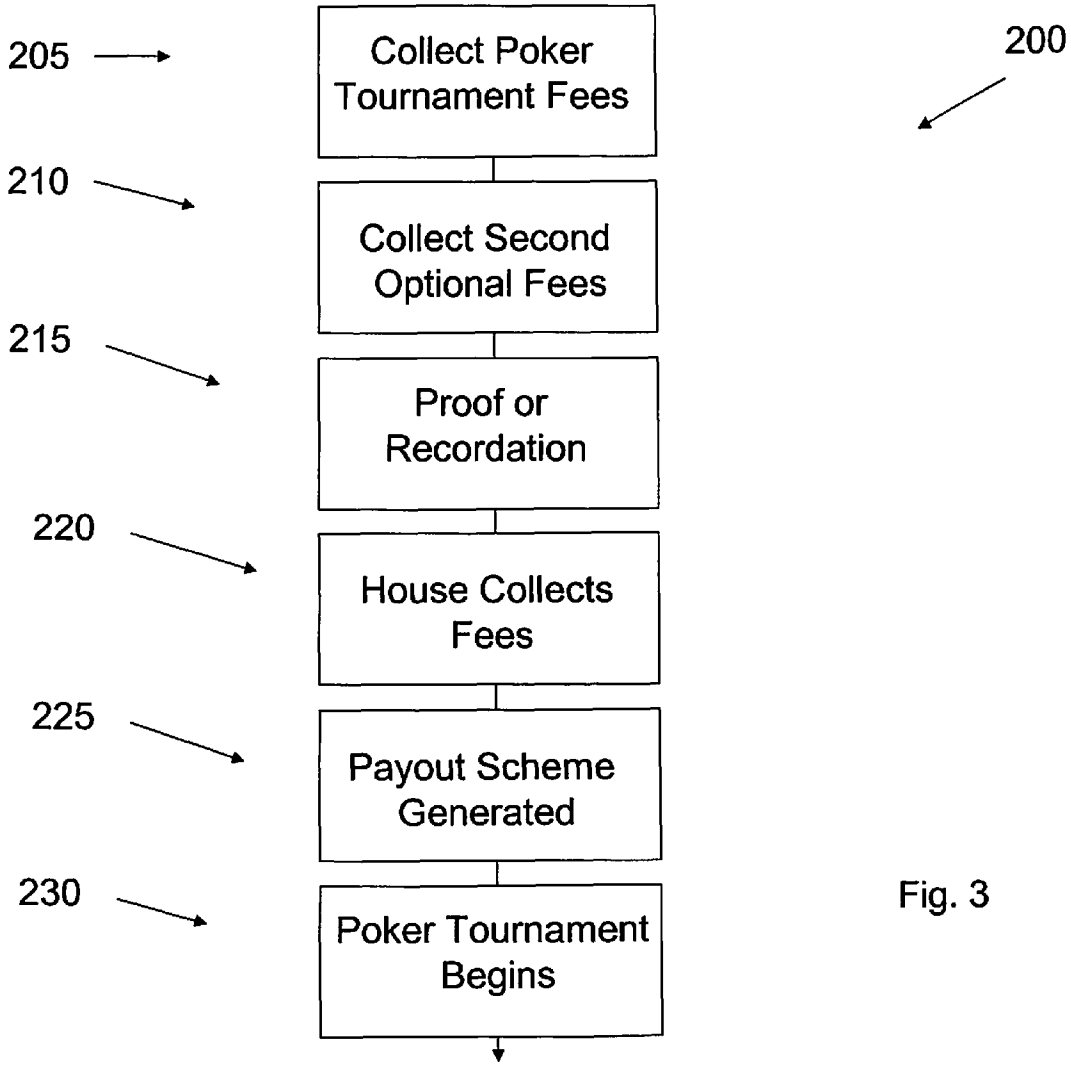
FIG. 3 illustrates a flow chart detailing a method of conducting a poker tournament according to a first embodiment of the present invention.
Figure 3:
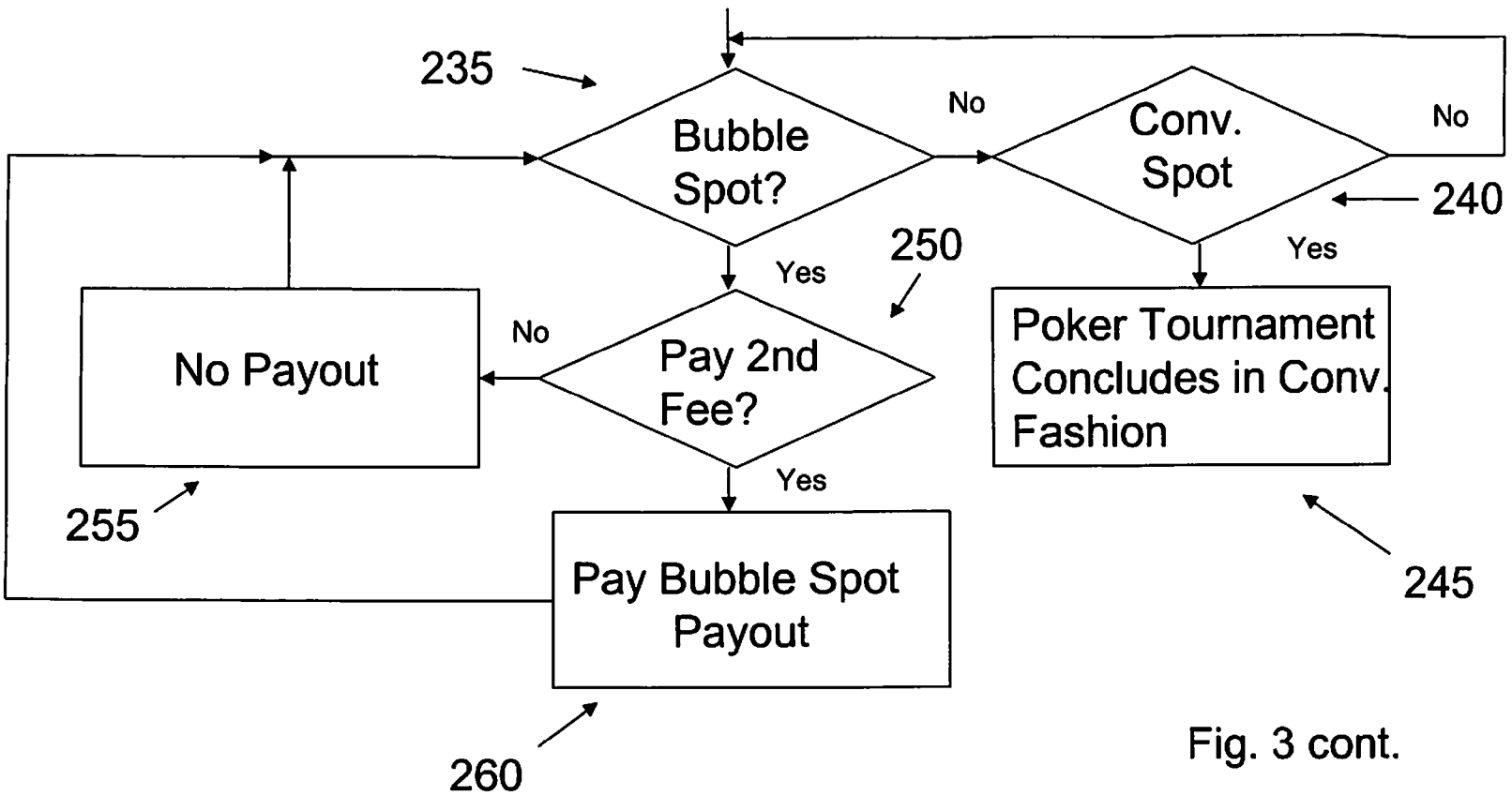

FIG. 3 shows a flow chart 200 detailing a method of conducting a poker tournament according to the embodiments of the present invention. At 205, poker tournament entry fees are collected. At 210, second optional fees are collected. At 215, players paying the second optional fee are provided proof of payment or the house records the payment. Proof may comprise a special token, receipt, voucher or similar tangible item which allows the house confirm the player paid the second optional fee in the event the player finishes in one of the additional bubble spots. At 220, the house collects its percentage of the poker tournament fees and second optional fees. At 225, a payout scheme is generated using the poker tournament fees (e.g., spots equal to 10% of total entrants paid) along with payouts for additional bubble spots based on the second optional fees. At 230, the poker tournament begins. At 235, it is determined whether the player being eliminated from the tournament is at a level associated with the one or more additional bubble spots. If not, at 240, it is determined whether the conventional payout spots have been reached. If the conventional payout spots have been reached, the chart advances to step 245 where the poker tournament concludes in a conventional fashion with each eliminated player receiving a conventional payout according to the payout scheme. If, at 240, the conventional payout spots have not been reached, the chart 200 loops back to step 235. If, at 235, it is determined the player is at a bubble spot, at 250, it is determined whether the player paid the second optional fee. If not, at 255, the player receives no payout and the chart loops back to step 235. If the player did pay the second optional fee, at 260, the player receives a payout associated with the specific bubble spot finish.

In a poker room setting, it is likely that the embodiments of the present invention will be facilitated by software. Poker rooms currently use commercially available software to manage conventional poker tournaments. The commercial software maintains number of entrants, prize pool, payout spots and payout amounts (after the house takes it portion). The software interacts with one or more displays in the poker room wherein said displays depict tournament levels, number of players remaining, average chip stacks, etc. Accordingly, in one embodiment of the present invention the software is developed to integrate with the commercial software. Alternatively, the software according to the embodiments of the present invention may be completely separate. In either instance, based on user customization, the software according to the embodiments of the present invention automatically tracks the number of second optional fees paid and the pool generated thereby. Then, based on further user customization, generates a number of additional bubble spots and corresponding payouts. This information may be displayed on the current displays in conjunction with the other tournament information referenced above.

With an online embodiment, the second option fee is made available for players signing up to play poker tournaments and the Internet server running appropriate software manages the additional bubble spots, corresponding payouts and the like. Indeed, all facets of the live game may be implemented in online embodiments.

Those skilled in the art will recognize that the amount of the second optional fees, number of additional bubble spots, payouts associated with a player paying the second optional fee and finishing in an added bubble spot and the like may be modified and optimized as deemed appropriate by the operator offering the same.

Although the invention has been described in detail with reference to several embodiments, additional variations and modifications exist within the scope and spirit of the invention as described and defined in the following claims.

We claim:

1. A method of conducting a poker tournament comprising:

accepting bubble fees from players and recording player information from players paying said bubble fees, said bubble fees distinct from a poker tournament entry fee;

determining if players finishing in said one or more bubble positions paid said bubble fee, said bubble positions outside of pre-established payout positions based on a number of tournament entrants; and providing a bubble award to any player finishing in one of said one or more bubble positions and having paid said bubble fee.

2. The method of claim 1 further comprising not providing a bubble award to any players finishing in said one or more bubble positions and not having paid said bubble fee.

3. The method of claim 1 facilitated by a computer network.

4. The method of claim 1 further comprising collecting a percentage of said bubble fees as compensation.

5. The method of claim 1 further comprising establishing said bubble fee in a range of 1% to 20% of the poker tournament entry fee.

6. A computer implemented method of conducting a poker tournament having two or more payout positions comprising:

utilizing at least a processor, memory and user interface to:

allow tournament players to pay bubble fees via said user interface, said bubble fees distinct from a poker tournament entry fee;

prior to a start of the poker tournament, accept via said user interface bubble fees from players and record into said memory player information from players paying said bubble fees;

determining via said processor if any players paying said bubble fees finish in said one or more bubble positions, said bubble positions outside of said two or more payout positions; and providing an award via said processor to any player finishing in one of said one or more bubble positions and having paid said bubble fee as recorded in said memory.

7. The method of claim 6 further comprising not providing a bubble award to any players finishing in said one or more bubble positions and not having paid said bubble fee.

8. The method of claim 6 facilitated by a computer network.

9. The method of claim 6 further comprising collecting a percentage of said bubble fees as compensation.

10. The method of claim 6 further comprising establishing said bubble fee in a range of 1% to 20% of the poker tournament entry fee.

11. A method of conducting a poker tournament comprising:

accepting a poker tournament entry fee from tournament players;

establishing a tournament payout structure based on a number of poker tournament entry fees accepted, said payout structure including two or more payout positions;

accepting optional bubble fees from players;

recording player information of players paying said bubble fees;

determining if any players paying said bubble fees finish in said one or more bubble positions, said bubble positions in addition to said two or more payout positions; and providing an award to any player finishing in one of said one or more bubble positions and having paid said bubble fee as recorded in said memory.

12. The method of claim 11 further comprising not providing a bubble award to any players finishing in said one or more bubble positions and not having paid said bubble fee.

13. The method of claim 11 facilitated by a computer network.

14. The method of claim 11 further comprising collecting a percentage of said bubble fees as compensation.

15. The method of claim 11 further comprising establishing said bubble fee in a range of 1% to 20% of the poker tournament entry fee.

* * * * *